United States Patent [19]

Brattström et al.

[11] Patent Number: 4,831,936

[45] Date of Patent: May 23, 1989

[54] ARMOR PIERCING SHELL

[75] Inventors: Leif Brattström; Hans Gustafsson, both of Karlskoga; Tommy Ström, Degerfors, all of Sweden; Bertil Arvidsson, Richmond, Tex.; Sture Cergéus, Vällingby, Sweden

[73] Assignee: Aktiebolaget Bofors, Bofors, Sweden

[21] Appl. No.: 140,917

[22] Filed: Dec. 31, 1987

Related U.S. Application Data

[63] Continuation of Ser. No. 822,569, Jan. 27, 1986, abandoned.

[30] Foreign Application Priority Data

Jan. 31, 1985 [SE] Sweden ..... 8500426

[51] Int. Cl.[4] ..... F42B 13/10

[52] U.S. Cl. ..... 102/476; 102/216; 102/272; 102/499

[58] Field of Search ..... 102/216, 272, 476, 499, 102/517, 519

[56] References Cited

U.S. PATENT DOCUMENTS

| | | | |
|---|---|---|---|
| 2,798,432 | 7/1957 | Meister | 102/272 |
| 3,373,687 | 3/1968 | Simmons | 102/476 |
| 4,209,146 | 6/1980 | Mattson . | |
| 4,334,657 | 6/1982 | Mattson . | |
| 4,353,305 | 10/1982 | Moreau et al. | 102/519 |
| 4,463,678 | 8/1984 | Wiemer . | |
| 4,487,130 | 12/1984 | Brattstrom et al. . | |

FOREIGN PATENT DOCUMENTS

| | | | |
|---|---|---|---|
| 2605455 | 2/1976 | Fed. Rep. of Germany . | |
| 1075129 | 10/1954 | France | 102/216 |
| 2311271 | 12/1976 | France . | |

*Primary Examiner*—Harold J. Tudor

*Attorney, Agent, or Firm*—Pollock, Vande Sande & Priddy

[57] ABSTRACT

An armor piercing explosive shell comprises a hollow charge and an impact contact member placed in the nose cone of the shell and arranged to provide electrical contact for initiation of the hollow charge upon impact of the shell against the target. To improve the penetrative performance of the shell against targets protected by active armor the nose cone of the shell is provided with a reinforced tip for mechanical penetration of the active armor and the impact contact member does not extend all the way to the tip of the shell so that upon impact of the shell against the active armor contact is obtained only after the reinforced tip has penetrated the active armor.

4 Claims, 2 Drawing Sheets

ARMOR PIERCING SHELL

This application is a continuation of application Ser. No. 822,569, filed Jan. 27, 1986 now abandoned.

BACKGROUND OF THE INVENTION

The present invention relates to an armor piercing shell of the kind comprising a shaped or hollow charge and an impact contact member placed in the nose cone of the shell and arranged to provide electrical contact for initiation of the hollow charge upon impact of the shell against a target.

Different types of anti-tank ammunition used for combating of armored vehicles, particularly tanks, are known in the prior art. Such ammunition is designed to penetrate even thick armor plates. Armor piercing shells comprise a special type of anti-tank ammunition which is provided with a hollow charge warhead. In principle, a hollow charge comprises an outer casing, a metal cone and an explosive. When the explosive detonates, the metal cone is squeezed together and a metal jet is formed which, with great force, penetrates even very thick and hard armor. Due to its good effect in armored targets, the hollow charges have long constituted a serious threat to armored vehicles.

In consequence of the development that has taken place on the protection side through the introduction of composite armor, active armor, etc., the importance of improving the penetrability of the warhead has, however, increased. Developments have therefore led to increasingly longer and heavier hollow charges. In certain cases this can be accepted, typically for all-target shells etc., but for severely weight-optimized designs, with limited space etc., this method is inappropriate. With state-of-the-art technique, therefore, limit has been reached in practice as regards the length and weight of the charges.

In order to increase the penetrability, hollow charges differing from conventional hollow charges have also been developed in recent times. These charges can, for instance, comprise an auxiliary body disposed in front of or integrated with the metal cone of the charge so that upon initiation of the charge it generates a slug which follows behind the actual penetration jet and penetrates and enlarges the hole made by the penetration jet. Alternatively, the hollow charge may have a warhead with two complete hollow charges, so-called tandem hollow charges, which after the projectile is fired accompany each other as an integral unit during the greater part of the travel towards the target, only to separate at a predetermined distance from this and to continue towards the target at mutually slightly different velocities along largely the same trajectory and thereafter to hit the target with a sufficient interval of time to enable the charge which reaches the target first to detonate the explosive in any active armour before the second charge reaches the target, so that this latter charge penetration jet is able to work without disturbance and also is assisted by the penetration work already performed by the first charge which has already detonated within the same confined area of the charge. See Swedish patent application No. 8302727-6.

In order to function in the intended manner each of the two hollow charges in such a tandem hollow charge must have its own ignition system with associated safety device. To separate the two hollow charges, it is also necessary to have a smaller parting charge, e.g. a powder charge, between the two charges in order to impart to each of these its own velocity change.

It is realized that the penetrating ability against active armor can be increased significantly through two such interacting charges. It is also realized, however, that the warhead of the projectile will be significantly more expensive with two complete hollow charges, each including its own ignition system and a parting charge.

The object of the present invention is therefore to provide an armor piercing explosive shell in which improved penetrative performance against active armor has been accomplished in a considerably simpler manner. Instead of providing an extra hollow charge which is made to detonate the explosive in an active armor so that the following hollow charge is then able to work without disturbance, the invention is based on the ability of the nose cone of the shell to mechanically penetrate the active armor before the hollow charge is initiated. This means that the penetration jet of the hollow charge can pass undisturbed by the active armor so that full penetrability is obtained in the main target.

A further object of the invention is to provide an armor piercing explosive shell which can be manufactured by modification of already existing anti-tank ammunition, typically 9-cm ammunition.

According to the present invention the nose cone of the shell has a reinforced tip for mechanical penetration of active armor and the impact contact member is so positioned in the nose cone that contact is obtained only when the reinforced tip has penetrated aside the active armor without detonating.

Preferably, the tip of the nose cone is solid and sharper than in conventional anti-tank shells and the impact contact member is not extended all the way to the tip of the shell. By this means, the delay is accomplished which is required in order for the shell to have time to penetrate the active armor before the hollow charge is initiated.

Preferably, the casing in the nose cone cap of the shell is also made of a harder material than in a conventional shell, for example a high-strength steel.

In the present invention only the front part of the shell, the nose cone or cap, is modified so that existing ammunition can easily be adapted by replacement of the nose cone or cap. A certain increase in the volume of the shell of the nose cone is obtained, but this is not believed to have any appreciable influence on the properties of the shell.

The invention will now be described in more detail with reference to the accompanying drawings, in which

DESCRIPTION OF THE PREFERRED EMBODIMENT

Figure 1:
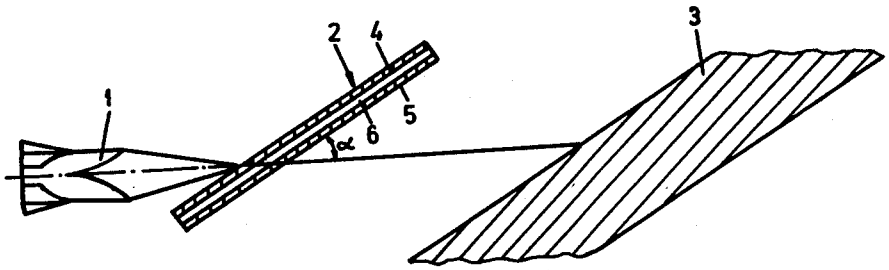
FIG. 1 shows schematically the function of an armor piercing explosive shell which penetrates an armoured target equipped with active appliqué armor.

FIG. 1 shows an armor piercing explosive shell 1, for example a 9-cm armor piercing explosive shell m/77, which penetrates an armor target equipped with active armour of appliqué type 2 placed in front of and at a distance from the main armor 3 of the target. Such active armour may typically comprise two steel plates 4, 5 with an interlying layer 6 of pentyl explosive paste. Normally, active armour of this kind will disturb the hollow charge jets of the shell, its penetrative performance being drastically reduced due to the fact that the jet is broken up into fragments which tumble and are dispersed. The angle of impact is typically in the range of 20°–60°.

According to the present invention the shell 1 is, however, provided with a new type of nose cone which has the capability of penetrating the active armor before the hollow charge function is initiated. By this means the hollow charge jet can give its normal effect. The active armor is in fact not initiated by the tip of the shell. In a conventional armor piercing explosive shell, in contrast, the hollow charge jet is initiated much earlier and the tip does not have time to penetrate the active armor. In this case the hollow charge jet will therefore initiate the active armor.

Figure 2:
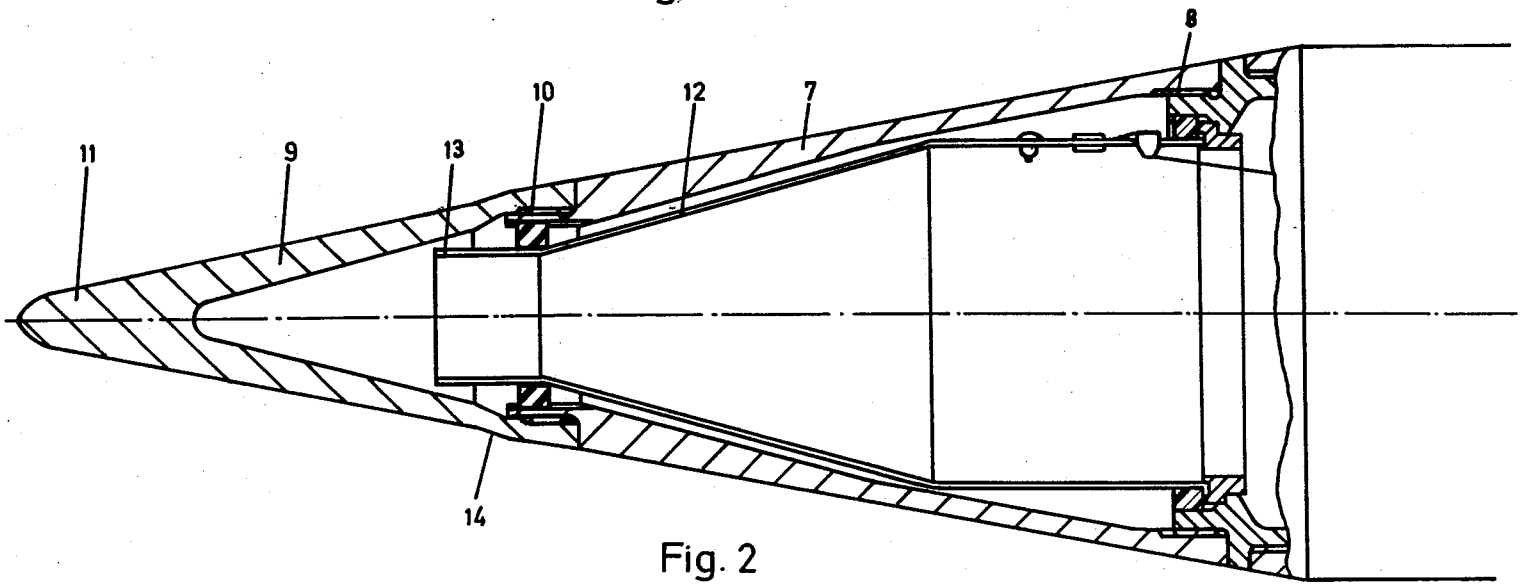
FIG. 2 shows a preferred embodiment of a divided nose cone, i.e. a nose cone equipped with a cap.

Shown in FIG. 2 is the front part of an armor piercing explosive shell equipped with a first embodiment of a nose cone with a reinforced tip according to the invention. The nose cone comprises two parts, a rear part 7 which is screwed onto the body of the shell by means of a thread 8 and a front part, the cap 9 which is screwed onto the rear part 7 of the cone by means of a thread 10.

As evident from the figure the cap 9 is provided with a solid tip 11 and has a conically rearward narrowing wall thickness. The material thickness of the tip in the longitudinal direction is thus at least 4–5 times the wall thickness of the cap or nose cone otherwise. The tip has a decidedly small tip radius, i.e. an appreciably sharper tip than a conventional armor piercing explosive shell. The tip is optimated to be able to penetrate aside the active armor without this detonating.

The cap is made of a high-strength steel which has been optimized in terms of hardness and plasticity. The ruptural strength of the material should be of the order of 1,000 N/mm$^2$ in comparison with 250 N/mm$^2$.

The nose cone also comprises an impact contact member in the form of a full-caliber double sheath, an outer sheath incorporated in the outer casing of the shell and an inner sheath 12. The outer and inner sheaths are disposed in an unused shell at a distance from and isolated from each other so as upon impact of the shell against the target to be able to enter into coaction and make electrical contact with each other. The sheath forms a passive end contact in the ignition system of the shell (not shown) for initiation of the hollow charge.

In comparison with previously known, conventional armor piercing explosive shells of this kind, the contact member, the inner sheath 12, is not extended all the way to the tip of the nose cone. This means that contact is obtained first when the deformation reaches the rear portion of the cap 9, i.e. the reinforced tip is able to penetrate active armor before the hollow charge is initiated. The front cylindrical portion 13 of the contact member extends inside the cap, but only into its very rearmost portion at the threaded joint 10.

In modifying existing ammunition, only the cap 9 is changed and the front portion of the contact member removed. In order to impart greater strength to the cap at the threaded joint 10, the cap has an increased cone angle in the form of a "hunch" 14.

Figure 3:
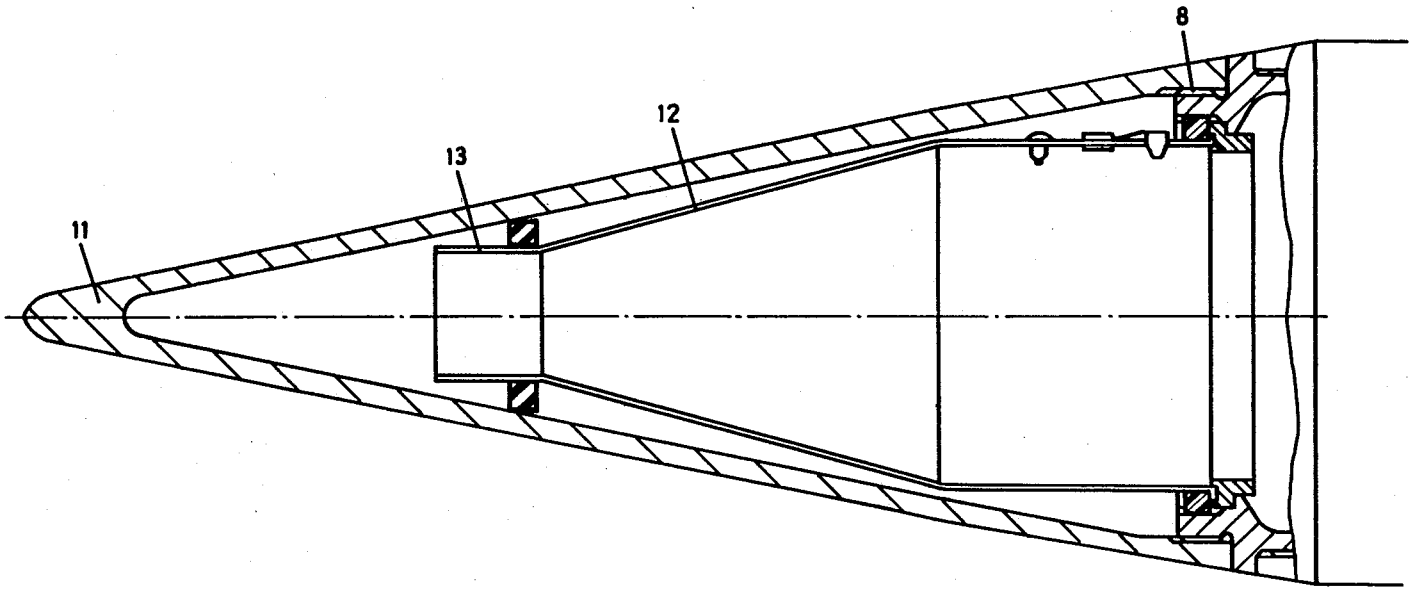
FIG. 3 shows an alternative embodiment of the nose cone.

Illustrated in FIG. 3 is an alternative embodiment of the nose cone. In this case also the tip is reinforced, solid and with a material thickness of at least approx. four times the wall thickness in the cone. In this case, however, the cone is an integral (undivided) unit and is screwed onto the shell body by means of a thread 8. The wall of the nose cone is made of a harder material than in a conventional shell and the impact contact member does not extend all the way to the tip of the shell, all in accordance with the first embodiment according to FIG. 2. The same reference designations have been used for corresponding parts.

We claim:

1. An armor-piercing explosive shell comprising in combination:

(a) a rear portion containing a hollow charge, (b) a front portion connected to said rear portion and comprising a substantially cone-shaped outer casing defining an interior cavity, said outer casing having a wall thickness extending rearwardly of its forwardmost portion which is substantially greater than the wall thickness rearwardly of said forwardmost portion to provide a reinforced tip, (c) said interior cavity containing an electrical contact member which is of generally frustro-conical shape over at least a portion of its length, (d) and means for supporting said electrical contact member within said front portion in such manner that said frustro-conically shaped portion is closely spaced from the interior surface of said first portion, said electrical contact member stopping short of extending into the forwardmost portion of said front portion having said substantially greater wall thickness, (e) and means effective only when said outer casing is deformed to a sufficient extent rearwardly of its forwardmost end by its impingement upon and at least partial penetration of a target to result in electrical contact being made between said front portion and said electrical contact member to detonate said hollow charge.

2. An explosive shell according to claim 1 wherein at least the front portion of the nose cone of the shell is made of a hard material of a high-strength steel with a ruptural limit of the magnitude of about 1,000 N/mm$^2$.

3. An explosive shell according to claim 1 wherein said front portion comprises a forward portion constituting a separate cap with a solid tip connected to a rear part of the front portion by a threaded joint.

4. An explosive shell according to claim 1 wherein the solid tip has a thickness in the longitudinal direction of the shell of at least 4 times the wall thickness of the shell casing of the front portion.

* * * * *